US006220050B1

(12) United States Patent
Cooksey

(10) Patent No.: US 6,220,050 B1
(45) Date of Patent: Apr. 24, 2001

(54) SUCTION ACCUMULATOR

(75) Inventor: Edward A. Cooksey, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/434,615

(22) Filed: Nov. 5, 1999

Related U.S. Application Data

(60) Provisional application No. 60/109,859, filed on Nov. 24, 1998.

(51) Int. Cl.[7] ..... F25B 43/00
(52) U.S. Cl. ..... 62/503; 62/513
(58) Field of Search ..... 62/503, 513, 113, 62/505

(56) References Cited

U.S. PATENT DOCUMENTS

| | | | | |
|---|---|---|---|---|
| 4,178,765 | | 12/1979 | Slayton | 62/83 |
| 4,607,503 | * | 8/1986 | Fry | 62/503 |
| 4,611,473 | * | 9/1986 | Wada et al. | 62/503 |
| 4,615,184 | | 10/1986 | Kobayashi et al. | 62/512 |
| 4,745,778 | | 5/1988 | Carella et al. | 62/512 |
| 4,794,765 | | 1/1989 | Carella et al. | 62/512 |
| 4,888,962 | * | 12/1989 | Harper et al. | 62/503 |
| 5,088,294 | | 2/1992 | Ando | 62/119 |
| 5,228,315 | | 7/1993 | Nagasaka et al. | 62/509 |
| 5,507,159 | * | 4/1996 | Cooksey | 62/503 |
| 5,546,761 | | 8/1996 | Matsuo et al. | 62/509 |
| 5,592,830 | | 1/1997 | Baba et al. | 62/509 |
| 5,628,206 | | 5/1997 | Baba | 62/507 |
| 5,713,217 | | 2/1998 | Baba | 62/509 |
| 5,733,106 | | 3/1998 | Lee | 417/312 |
| 5,749,714 | | 5/1998 | Lee | 417/312 |
| 5,873,261 | * | 2/1999 | Bae | 62/503 |

* cited by examiner

*Primary Examiner*—Corrine McDermott
*Assistant Examiner*—Marc Norman
(74) *Attorney, Agent, or Firm*—Baker & Daniels

(57) ABSTRACT

A compressor and suction accumulator assembly including an accumulator assembly attached to a compressor assembly. The compressor assembly includes a curved housing and the accumulator assembly defines a hip flask shaped housing having a concave surface which partially surrounds the curved compressor housing. The accumulator housing includes an inlet and an outlet whereby the outlet of the accumulator housing is in fluid communication with the compressor housing and the concave surface of the accumulator housing is superposed with the outer surface of the compressor housing to promote heat transfer therebetween.

14 Claims, 17 Drawing Sheets

SUCTION ACCUMULATOR

CROSS-REFERENCE TO RELATED APPLICATION

This application is related to and claims the benefit under 35 U.S.C. § 119(e) of U.S. Provisional Application No. 60/109,859, filed Nov. 24, 1998.

BACKGROUND OF INVENTION

The present invention relates to suction accumulators for hermetic refrigerant compressors, and in particular, to so-called "high side" compressors, i.e., compressors in which the interior of the compressor housing, including the motor chamber, is at discharge pressure.

While it is known to simply attach a cylindrical accumulator vessel to the cylindrical housing of a hermetic compressor, such an arrangement provides a compressor and accumulator assembly package which requires a substantial amount of space. Further, compressors typically generate heat which is thereafter emitted through the housing and into the surrounding air space. Accumulator assemblies heretofore, typically have been thermally isolated, or far enough removed from the compressor housing so that insignificant heat transfer, from the compressor housing to the accumulator housing, occurs. Generally, the accumulator assembly includes liquid refrigerant therein, and through the rather slow process of natural vaporization, the liquid refrigerant transforms to gaseous refrigerant, however, utilizing heat generated by the compressor housing, significantly accelerates vaporization as the accumulator is exposed to the generated heat. Thus, a typical accumulator is often required to store a substantial amount of liquid refrigerant during compressor operation, necessitating a larger accumulator volume. An accumulator which provides faster liquid refrigerant vaporization is desirable because it may be smaller, reducing the package space necessary for the compressor and accumulator assembly. Further, an accumulator which, when attached to a hermetic compressor, requires less package space is also desirable.

SUMMARY OF THE INVENTION

The present invention overcomes the disadvantages associated with prior accumulator and compressor assemblies in that it provides an accumulator disposed in close proximity to the compressor and having a shape which conforms to, or partially wraps about, the cylindrical compressor housing, providing increased heat transfer area between the components, thereby promoting high heat transfer from the compressor to the liquid refrigerant within the accumulator. Hence, the amount of liquid refrigerant which the accumulator must store during compressor operation may be reduced, for it will vaporize quickly and enter the compressor suction inlet. Further, because the inventive accumulator has a shape rather like a hip flask, having a generally kidney-shaped cross section which partially wraps about the outer surface of the compressor housing, a more compact compressor and accumulator assembly package size is afforded.

The present invention provides a compressor assembly and an accumulator assembly attached to the compressor assembly, wherein the compressor assembly includes a curved housing and the accumulator assembly includes a concave surface which partially surrounds the curved compressor housing.

The present invention also provides a compressor and suction accumulator assembly including a compressor mechanism disposed in a compressor housing and the compressor housing has an outer surface disposed thereon. The accumulator assembly includes an accumulator housing having an outer surface portion and the outer surface portion of the accumulator housing is interfacingly arranged with the outer surface of the compressor housing. The accumulator housing has an inlet and an outlet and the outlet is in fluid communication with the compressor mechanism. The outer surface portion of the accumulator housing is superposed with the outer surface of the compressor housing.

BRIEF DESCRIPTION OF THE DRAWINGS

The above-mentioned and other features and objects of this invention, and the manner of attaining them, will become more apparent and the invention itself will be better understood by reference to the following description of the embodiments of the invention taken in conjunction with the accompanying drawings, wherein.

Figure 1:
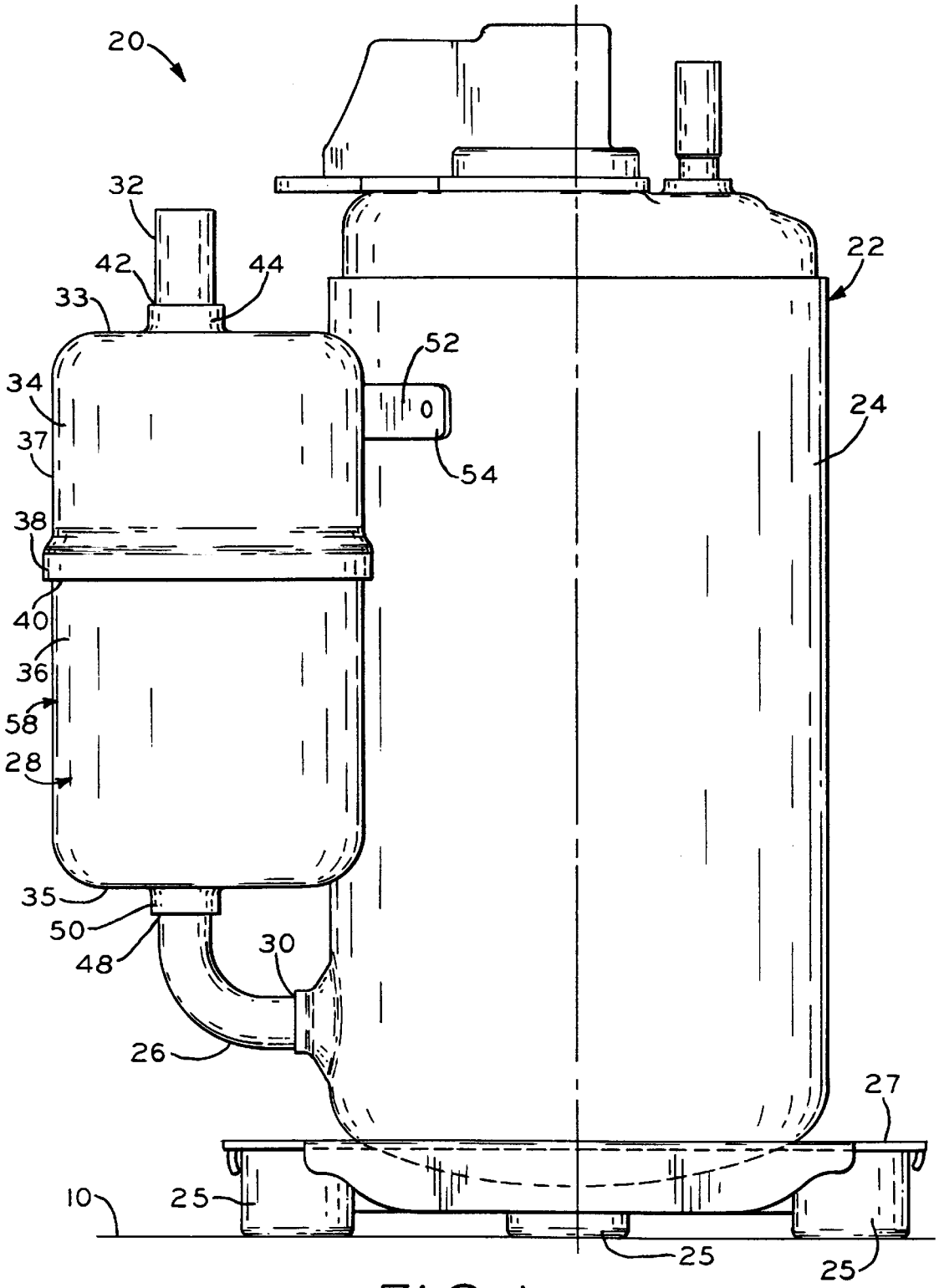
FIG. 1 is a first side view of a first embodiment of a compressor and accumulator assembly according to the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in alternative forms, and such exemplifications are not to be construed as limiting the scope of the invention in any manner.

DETAILED DESCRIPTION OF THE INVENTION

FIGS. 1–4 illustrate a first embodiment of a compressor and accumulator assembly according to the present invention. Compressor and accumulator assembly 20 comprises vertically oriented hermetic compressor assembly 22, which may be a rotary type compressor of the type disclosed in U.S. Pat. No. 4,640,669, assigned to the assignee of the present invention, the disclosure of which is expressly incorporated herein. Hermetic rotary compressor assembly 22 is of a type which is commonly known as "high side", i.e., the interior of the compressor housing 24, in which the motor is disposed, is generally at discharge pressure. It is to be understood, however, that compressor assembly 22 may be of a type other than rotary. For example, compressor assembly 22 may instead represent a high-side scroll or reciprocating piston compressor. Compressor assembly 22 is also of the type in which suction gases are provided from outside housing 24 to the compressing mechanism therein directly through suction inlet tube 26. Accumulator assembly 28 of the present invention is particularly beneficial in such "direct suction" compressor applications for in these applications the accumulator assembly also serves as a suction muffler. Compressor assembly 22 is vertically oriented and has base mounting bracket 27 attached to the lower portion of housing 24 and having mounting feet 25 which may be made of a vibration damping material such as, for example, rubber. The assembly is shown on generally horizontal mounting surface 10.

Figure 2:
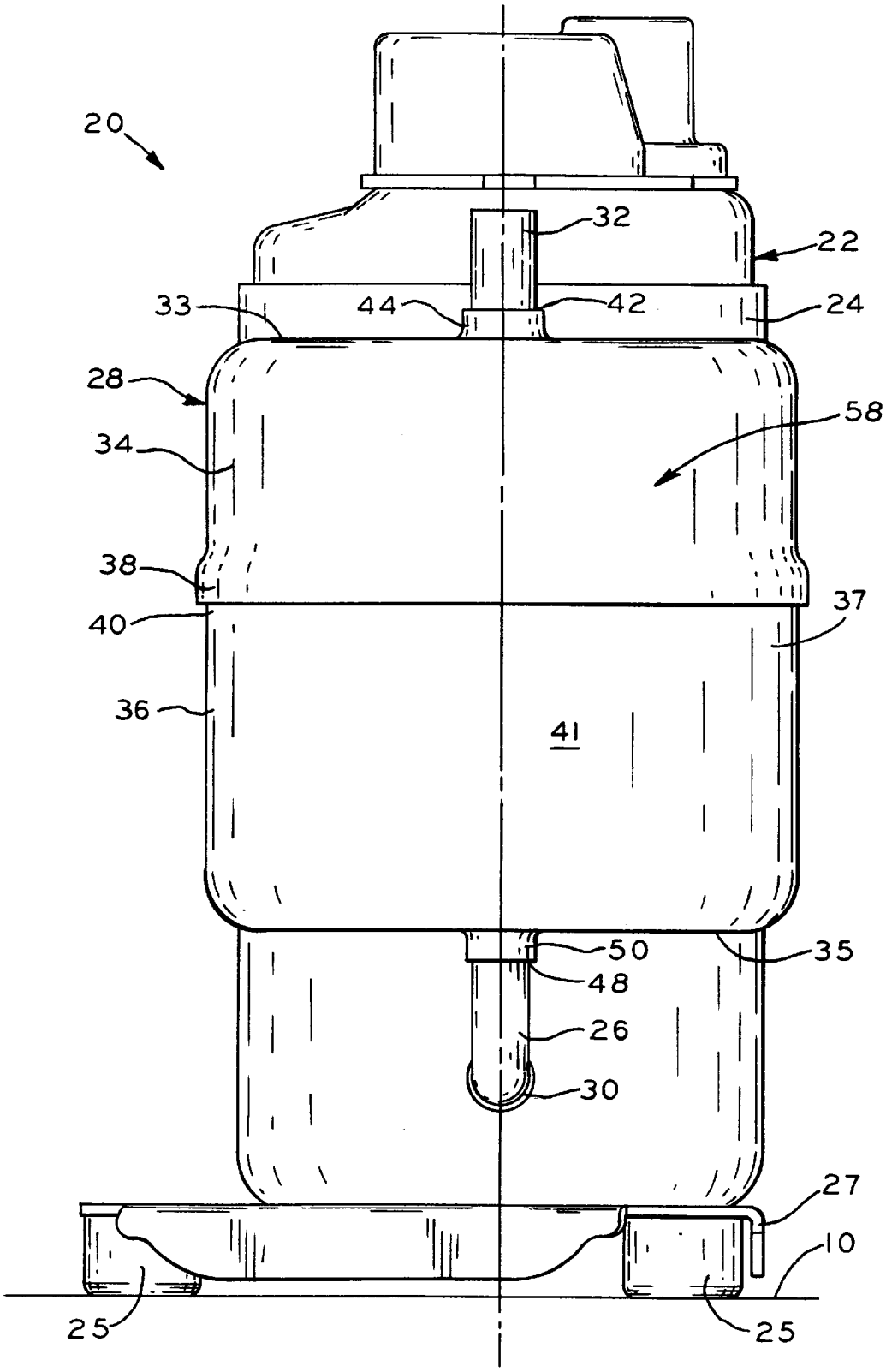
FIG. 2 is a second side view of the compressor and accumulator assembly of FIG. 1.

Referring to FIGS. 1 and 2, first suction inlet tube 26 extends through aperture 30 provided in the cylindrical sidewall of compressor housing 24 and is attached therein, by means of, for example, brazing. Suction inlet tube 26 connects to the inlet portion of the compressor mechanism (not shown) driven by an electric motor (not shown), both disposed within compressor housing 24. Gases compressed by the compressor mechanism are discharged into the interior of housing 24, from which they exit at discharge pressure through a discharge outlet tube (not shown) and are returned to the refrigerant system loop (not shown). Tube 26 may also be defined as the "outlet" of accumulator assembly 28, since refrigerant gas at suction pressure exits accumulator assembly 28 through tube 26. Tube 32 may also be defined as the "inlet" of accumulator assembly 28, since refrigerant is received by tube 32.

Figure 7:
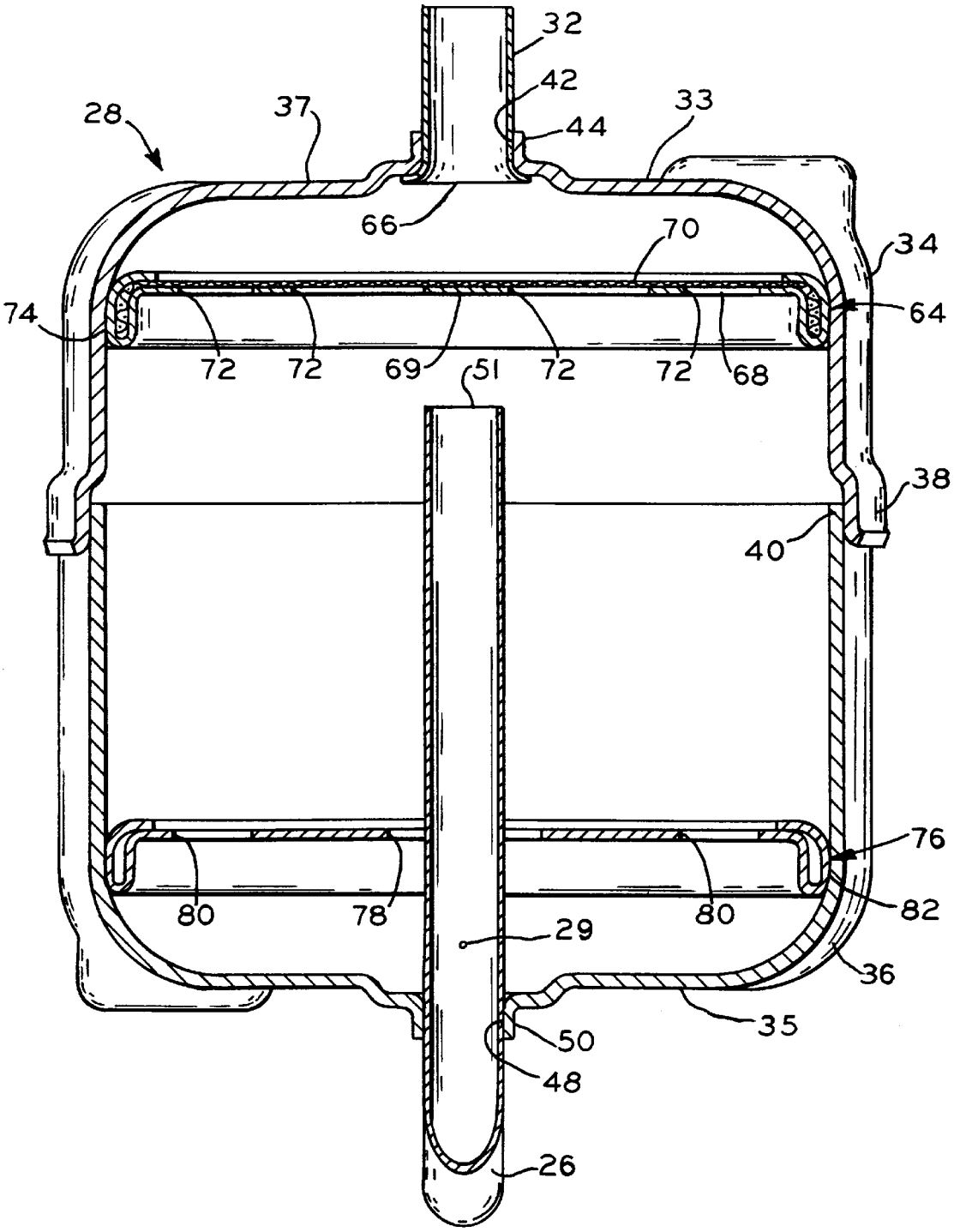
FIG. 7 is a sectional side view of the accumulator assembly of FIG. 6 along line 7—7.
Figure 8:
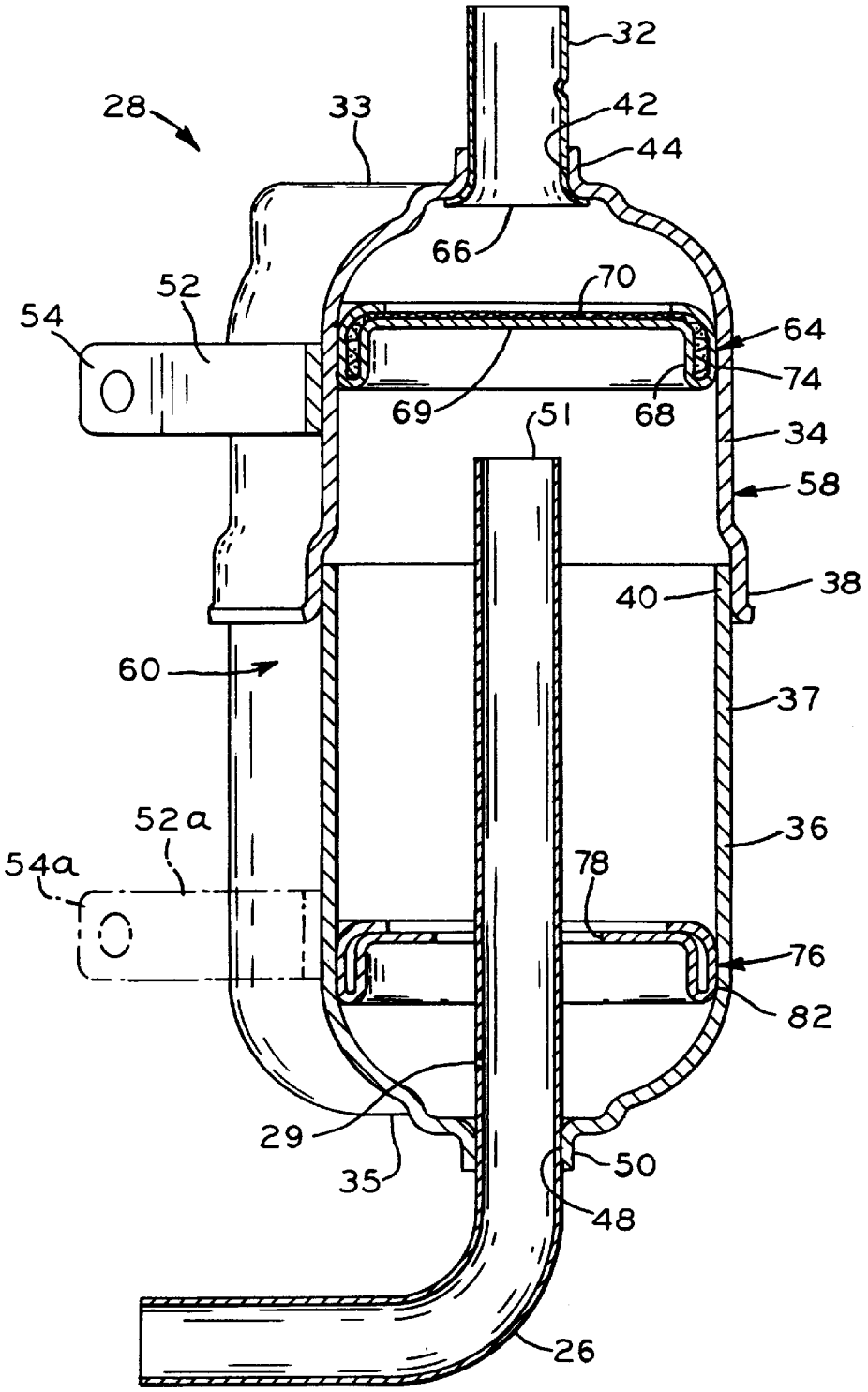
FIG. 8 is a sectional side view of the accumulator assembly of FIG. 6 along line 8—8.

As best shown in FIGS. 7 and 8, through hole or orifice 29 is positioned in a lower portion of outlet tube 26. Lubrication oil transported to accumulator assembly 28 with the refrigerant, which may accumulate at the lower portion of accumulator assembly 28, enters orifice 29 and is returned to compressor assembly 22 via tube 26. Orifice 29 includes a diameter which ranges from 0.025" to 0.060" to provide a means for lubrication oil to flow back to the compressor at a suitable rate.

Referring to FIGS. 1 and 2, accumulator assembly 28 comprises first accumulator housing portion 34 and second accumulator housing portion 36. First accumulator housing portion 34 includes end wall 33 having inlet tube 32 extending therethrough. Likewise, second accumulator housing portion 36 includes end wall 35 having outlet tube 26 extending therethrough. Housing portion 36 is adapted to be interfitted with lower end opening 38 of first accumulator portion 34 to form accumulator housing 37. First accumulator portion 34 includes an expanded portion into which upper end opening 40 of second accumulator portion 36 slidably extends. This joint is sealed by means of, for example, brazing. Second suction inlet tube 32 extends through aperture 42 in end wall 33 of first accumulator housing portion 34. Aperture 42 is defined by vertically extending collar 44 formed in end wall 33 of housing portion 34, and suction inlet tube is attached therein by means of, for example, brazing.

As best shown in FIGS. 7 and 8, outlet tube 26 extends through aperture 48 provided in end wall 35 of second accumulator housing portion 36; end wall 35 of accumulator housing portion 36 is provided with drawn collar portion 50 through which tube 26 extends and tube 26 is brazed into opening 48. Outlet tube 26 extends within accumulator assembly 28 to a height such that its terminal end 51 is located in the upper portion of the accumulator. Those skilled in the art will recognize that as refrigerant is introduced to accumulator assembly 28 through inlet tube 32, liquid refrigerant may accumulate in the bottom portion thereof, and as the liquid refrigerant vaporizes or boils off in response to it being at low pressure and/or its absorption of heat from the compressor assembly 22, the refrigerant gas will enter terminal end 51 of outlet tube 26 and be conveyed to the suction inlet of the compressor mechanism within compressor assembly 22.

Figure 3:
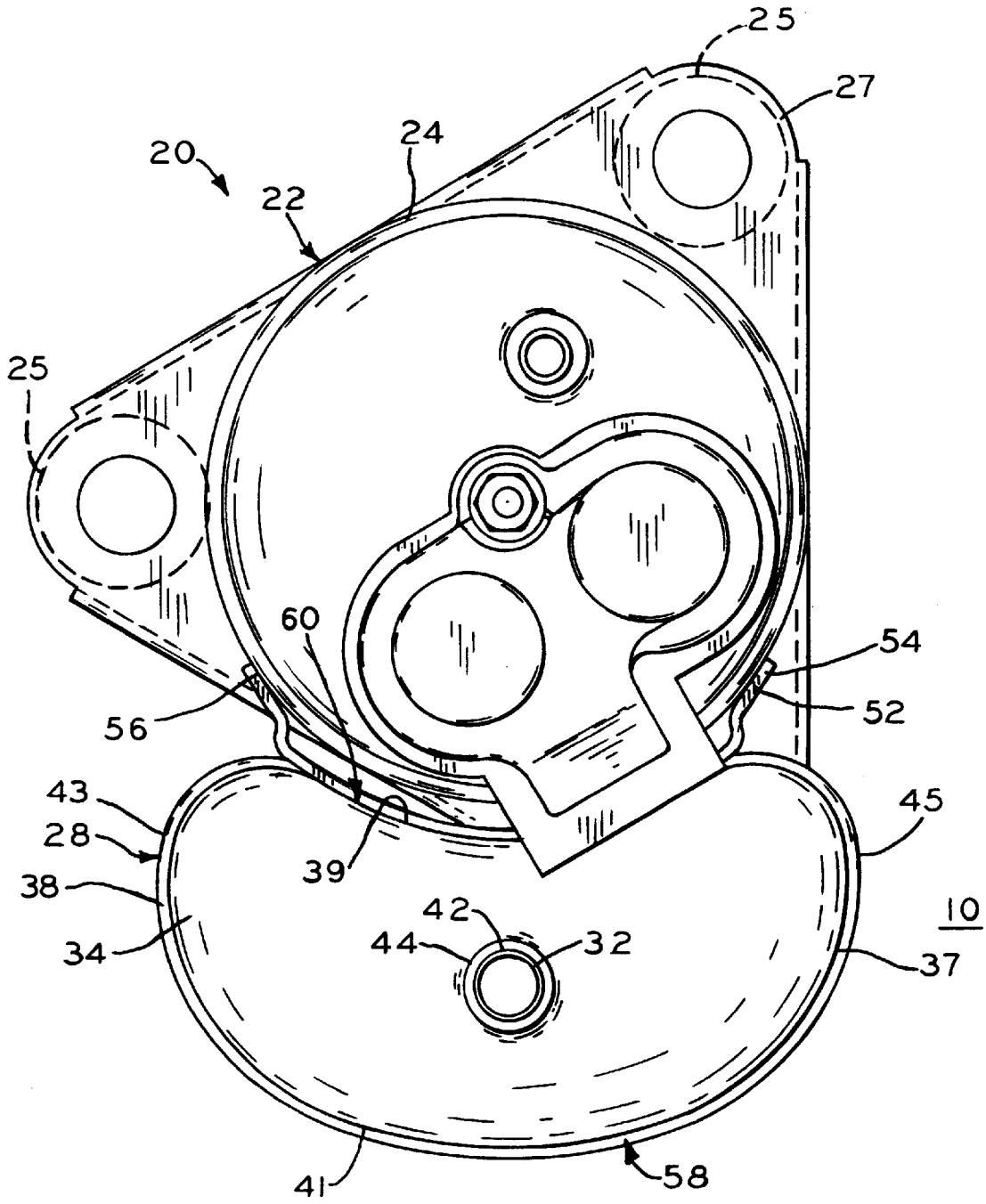
FIG. 3 is a top view of the compressor and accmulator assembly of FIG. 1.

Referring to FIGS. 1 and 3, it can be seen that accumulator assembly 28 includes mounting bracket 52 which is attached by means of, for example, brazing, to first accumulator housing portion 34, and is provided with first and second ends 54 and 56 which are attached by means of brazing, for example, to housing 24 of compressor assembly 22. Referring to FIG. 8, accumulator assembly 28 may be provided with additional second bracket 52*a*, which is identical to bracket 52 and which has first and second ends 54*a*, 56*a*(56*a* not shown) by which accumulator assembly 28 may be attached to compressor assembly housing 24. Accumulator assembly 28 is thus attached to compressor assembly 22 by means of the brazed connections of outlet tube 26 and the first and second ends of brackets 52, 52*a*.

Referring to FIGS. 1, 2 and 3, accumulator housing 37, formed from first and second accumulator housing portions 34 and 36, is generally hip flask shaped and includes a periphery or outermost portion having a kidney shaped cross-section. Specifically, accumulator housing 37 includes a generally continuous exterior surface which includes first surface portion 39 having concave profile 60 which interfaces with the generally curved outer surface of compressor housing 24. Opposite to concave profile 60, positioned radially and outwardly with respect to compressor assembly 22 and surface portion 39, is convex profile 58 disposed on second surface portion 41 of accumulator housing 37. Side portions, 43 and 45 having generally convex surfaces, connect convex profile 58 to concave profile 60 to form the hip flask shaped accumulator assembly 28. First surface portion 39 superposes, partially surrounding, the generally curved outer surface of compressor housing 24 to promote heat transfer to accumulator housing 37 from compressor housing 24. However, it is envisioned that the interfacing surfaces of accumulator housing 37 and compressor housing 24, may comprise alternative complementary profiles such as planar profiles, jagged profiles, curved profiles or any other suitable superposable profiles which promote high heat transfer and reduce overall assembly size.

Thus, heat generated by compressor assembly 22, via the compressor mechanism and/or the electrical motor therein, transfers to compressor housing 24 and thereafter to accumulator housing 37 to more rapidly vaporize the liquid refrigerant.

Furthermore, accumulator assembly 28, by partially surrounding or wrapping about cylindrical compressor housing 24, accommodates reduced compressor and accumulator assembly packaging requirements by providing radial compactness.

Figure 4:
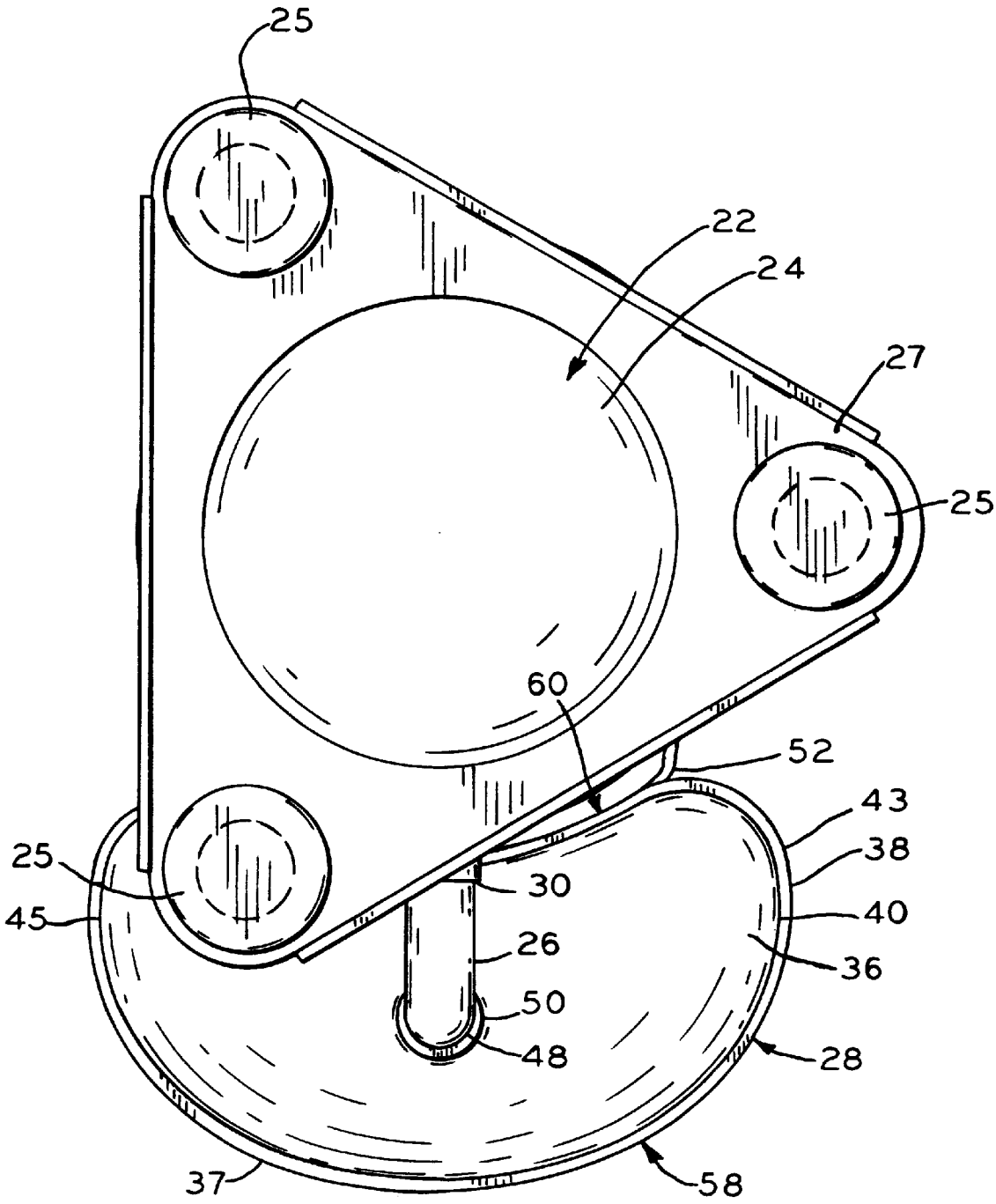
FIG. 4 is a bottom view of the compressor and accumulator assembly of FIG. 1.
Figure 5:
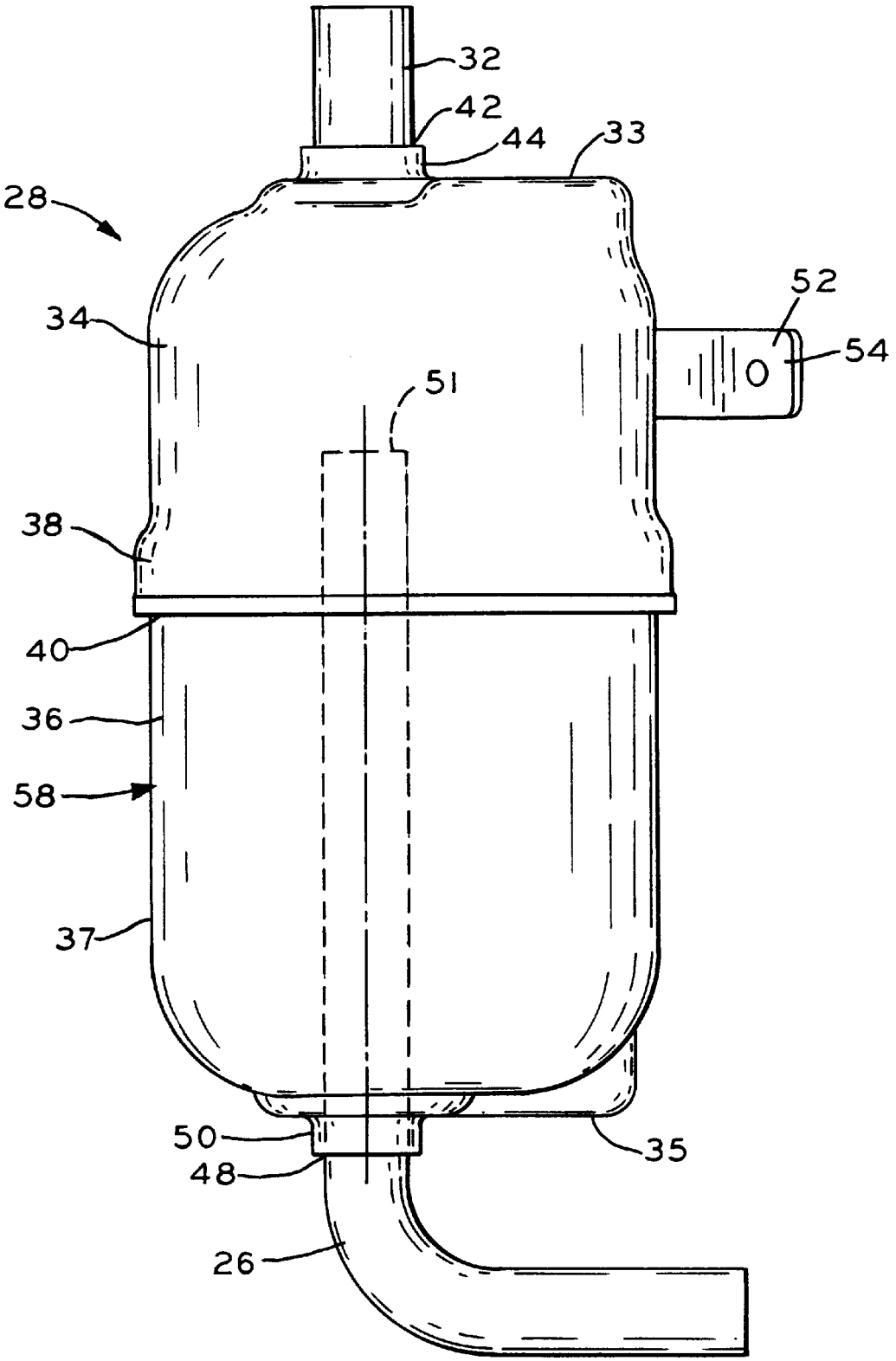
FIG. 5 is a side view of a first embodiment of an accumulator assembly according to the present invention.
Figure 6:
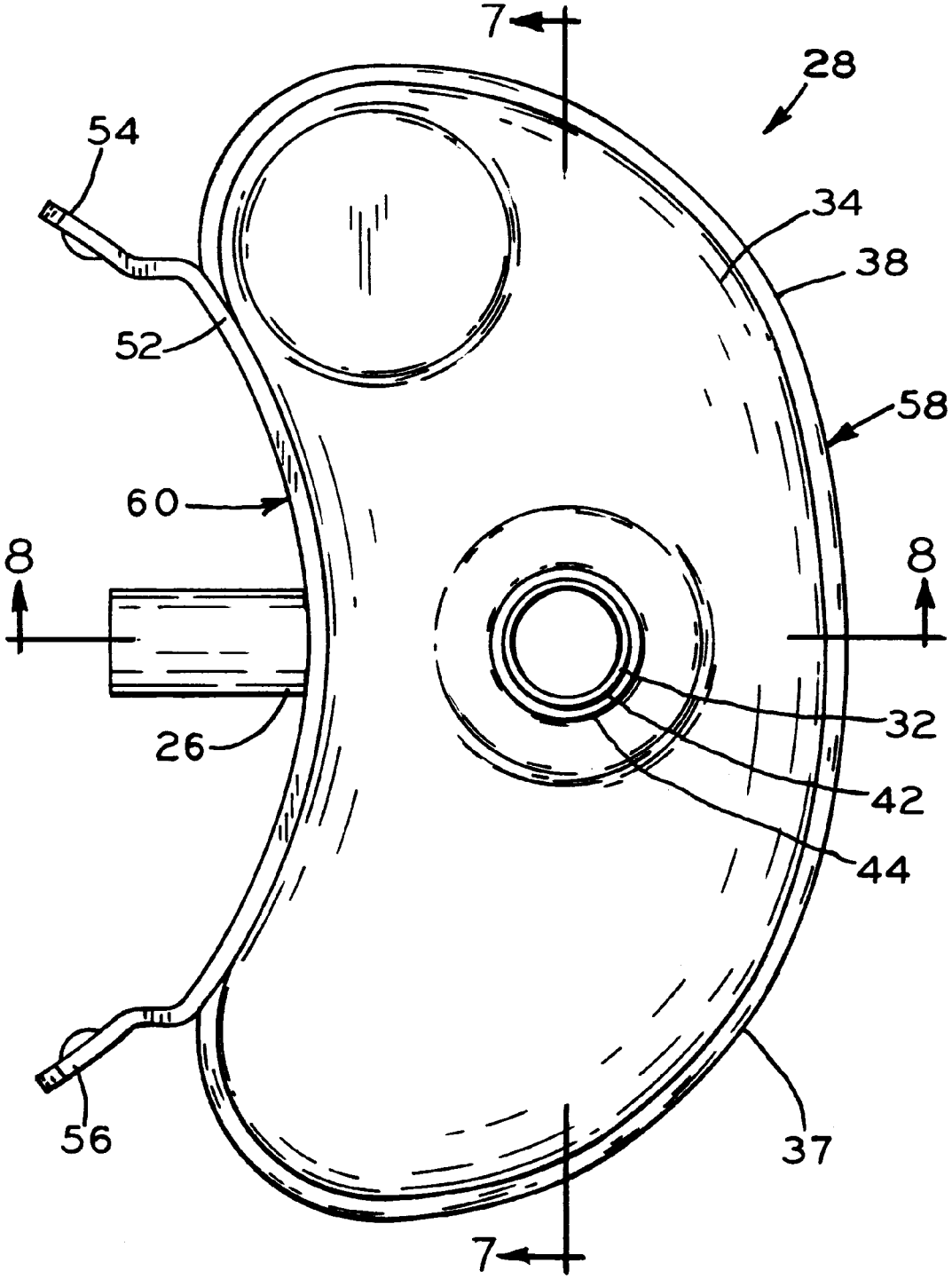
FIG. 6 is a top view of the accumulator assembly of FIG. 5.

Referring to FIGS. 3, 4, a gap between compressor housing 24 and concave profile 60 of surface portion 39 of accumulator housing 37 is in the range of approximately 5–10 mm. This clearance allows paint to be deposited on the interfacing surfaces to prevent corrosion of compressor housing 24 and accumulator housing 37. Those skilled in the art will recognize, however, that where suitable materials or surface protectants are used (e.g., platings) accumulator assembly concave profile 60 may be positioned so as to abuttingly contact the outer surface of compressor housing 24, thereby providing further improved heat transfer therebetween. The improved heat transfer characteristics of the inventive accumulator assembly provides more rapid vaporization of liquid refrigerant therein, thereby allowing the overall volumetric size of the accumulator to be minimalized, thus, refrigerant which would otherwise be stored as liquid in the accumulator instead is urged into a vapor phase.

Figure 9:
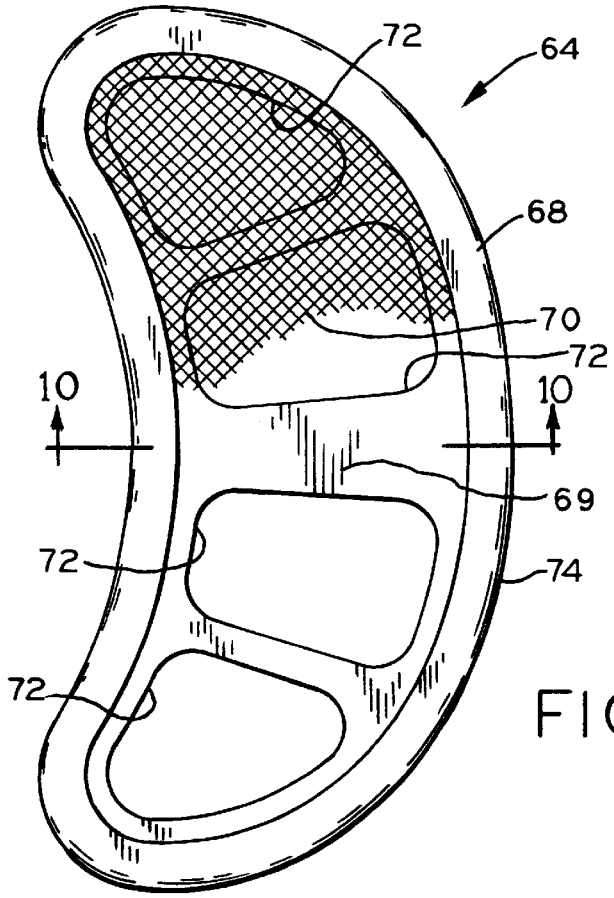
FIG. 9 is a top view of a screen assembly within the accumulator assembly of FIG. 5.
Figure 10:
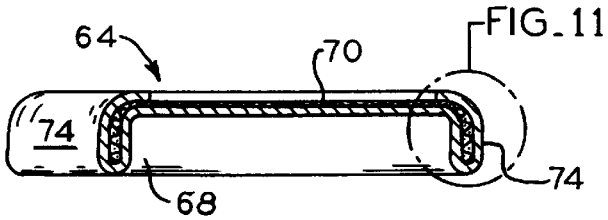
FIG. 10 is a sectional side view of the screen assembly of FIG. 9 along line 10—10.
Figure 11:
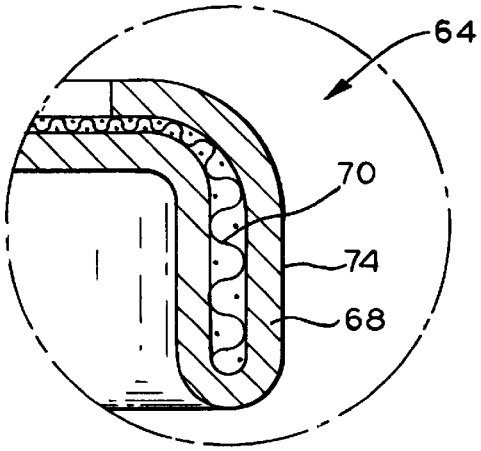
FIG. 11 is an enlarged view of the encircled portion of FIG. 10.

Referring to FIGS. 7 and 8, there is shown screen assembly 64 which is disposed within first accumulator housing portion 34, the screen assembly conforming to the interior surface of first housing portion 34. Screen assembly 64 is disposed intermediate terminal end 51 of outlet tube 26 and terminal end 66 of inlet tube 32. Screen assembly 64 comprises frame or holder 68 to which is attached screen element 70 by means of, for example, crimping (as shown), welding, riveting or by any other suitable means. Screen assembly frame 68 is provided with a plurality of openings 72 through which refrigerant may pass and which are completely covered by screen element 70. As best shown in FIGS. 7 and 9, screen assembly frame 68 is provided with central rib 69 which extends between center most openings 72. Rib 69 lies directly below terminal end 66 of inlet tube 32, and directly above terminal end 51 of outlet tube 26, and serves to deflect the flow of refrigerant from inlet tube 32, preventing the refrigerant from flowing directly into outlet tube 26 and into the compressor cylinder. Screen element 70 may be made from interwoven stainless steel, brass or other suitable metallic or non-metallic fibers having a mesh of 80×150 fibers/inch, and have the ability to withstand increased temperature and pressure conditions. Such a mesh will prevent debris measuring approximately 90 microns or more from passing from the refrigerant loop to the compressor, however, the screen mesh is anticipated to prevent debris measuring between 80 and 120 microns from passing through to the compressor. Frame 68 is provided with depending circumferential surface 74 which slidably contacts the interior surface of first accumulator housing portion 34 and which is attached thereto by means of, for example, press-fit, brazing or welding. Screen assembly frame 68, in addition to providing a substrate on which screen element 70 is supported, also provides a means of stiffening accumulator 28 and providing baffle means by which suction pressure pulses carried by the refrigerant may be dampened, improving the performance of accumulator assembly 28 as a suction muffler.

Figure 12:
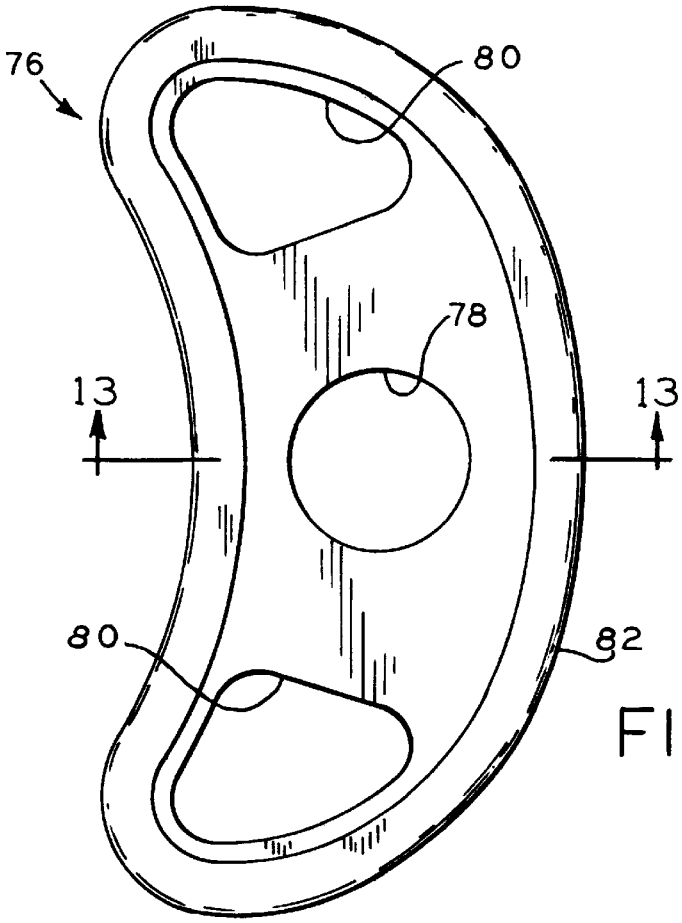
FIG. 12 is a top view of a baffle plate within the accumulator assembly of FIG. 5.
Figure 13:
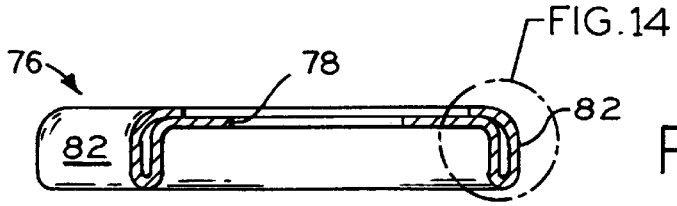
FIG. 13 is a sectional side view of the baffle plate of FIG. 12 along line 13—13.
Figure 14:
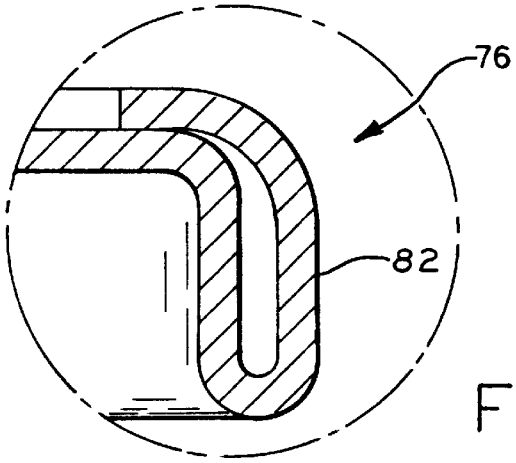
FIG. 14 is an enlarged view of the encircled portion of FIG. 13.

With reference again to FIGS. 7 and 8, baffle plate 76 is disposed in second accumulator housing portion 36. In the manner of screen assembly 64, baffle plate 76 conforms to the interior of the accumulator assembly and is provided with central aperture 78 through which outlet tube 26 extends. Baffle plate 76 has a plurality of other apertures 80 through which refrigerant may flow and depending circumferential surface 82 which slidably contacts the interior surface of second accumulator housing portion 36 and is attached thereto by means of, for example, brazing or welding. FIGS. 12–14 show baffle plate 76 in greater detail. Baffle plate 76 provides a means of stiffening accumulator 28 and, due to the material separating apertures 80, serves as a baffle for breaking up pressure pulses carried by the refrigerant flowing through the accumulator in the manner of screen assembly 64. Those skilled in the art will recognize that the filtration and/or muffling provided by screen assembly 64 or baffle plate 76 may not be necessary for all types of compressors and may accordingly be omitted from accumulator assembly 28 as appropriate. However, because of the close operating tolerances of the moving parts within a rotary compressor mechanism, it is particularly important to exclude refrigerant liquid from entering the compressor assembly.

Figure 15:
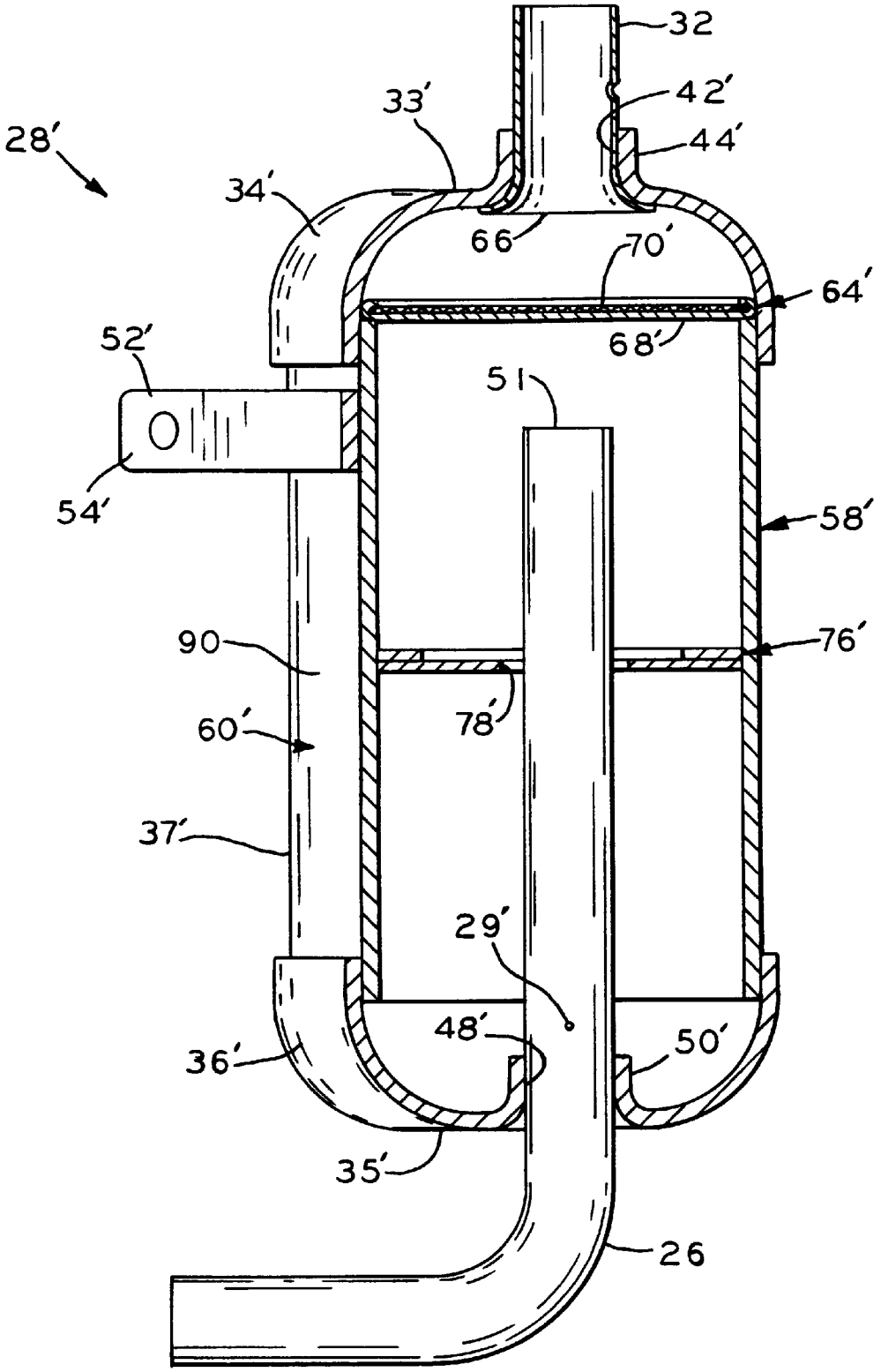
FIG. 15 is a sectional side view of a second embodiment of an accumulator assembly according to the present invention.

FIG. 15 shows a second embodiment of an accumulator assembly, according to the present invention, which may be used with compressor assembly 22. Unlike accumulator assembly 28, accumulator assembly 28' has a three piece housing construction. As shown, inlet and outlet tubes 32 and 26 are unchanged from the previously discussed embodiment, but accumulator assembly 28' includes first housing portion 34', second housing portion 36', and central housing portion 90 to form the hip flask shaped accumulator housing 37'. Central housing portion 90 slidably fits within the open ends of first and second accumulator housing portions 34', 36' and is attached thereto by means of, for example, brazing. Accumulator assembly 28' is otherwise substantially identical in outward appearance to accumulator assembly 28, having respective convex and concave profiles 58', 60', and is similarly provided with brackets 52' having ends 54', 56' (56' not shown) by which the accumulator assembly is attached to the exterior surface of compressor assembly housing 24.

As best shown in FIG. 15, through hole or orifice 29' is positioned in a lower portion of outlet tube 26. Lubrication oil transported to accumulator assembly 28' with the refrigerant, which may accumulate at the lower portion of accumulator assembly 28' , enters orifice 29' and is returned to compressor assembly 22 via tube 26. Orifice 29' includes a diameter which ranges from 0.025" to 0.060" to provide a means for lubrication oil to flow back to the compressor at a suitable rate.

Referring to FIG. 15, accumulator assembly 28' is provided with screen assembly 64' which is disposed at the upper axial end surface of central portion 90, and which is brazed thereto or to the interior surface of first accumulator housing portion 34' . Screen assembly 64' conforms to the interior surface of accumulator housing 37' and is provided with frame 68' and screen element 70' , which may be 80×150 mesh like screen element 70. Accumulator assembly 28' is provided with baffle plate 76' having central aperture 78' , through which outlet tube 26 extends, and a plurality of other apertures 80' (not shown). Baffle plate 76' conforms to the interior surface of central housing portion 90 and is attached thereto by means of, for example, brazing at a location intermediate first and second housing portions 34' , 36' . Further, end wall 35' of second accumulator housing portion 36' is provided with aperture 48' which is defined by upwardly extending collar 50' , through which outlet tube 26 extends into. Likewise, end wall 33' of first accumulator housing portion 34' is provided with aperture 42' which is formed by upwardly extending collar 44' , through which inlet tube 32 fits. Tubes 26 and 32, respectively, attach to collars 50' and 44' , respectively, by means of, for example, brazing.

Figure 16:
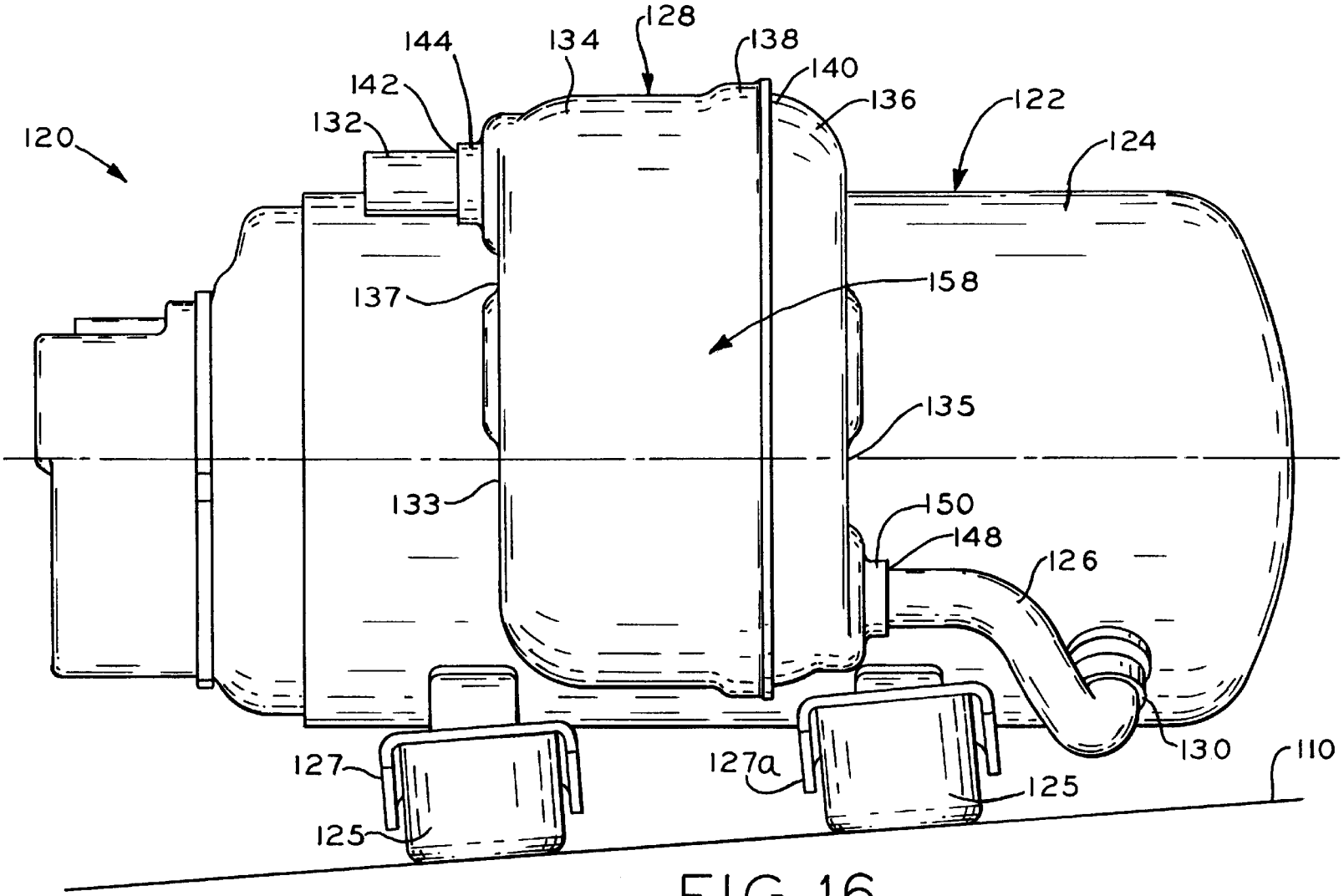
FIG. 16 is a first side view of a third embodiment of a compressor and accumulator assembly according to the present invention.
Figure 17:
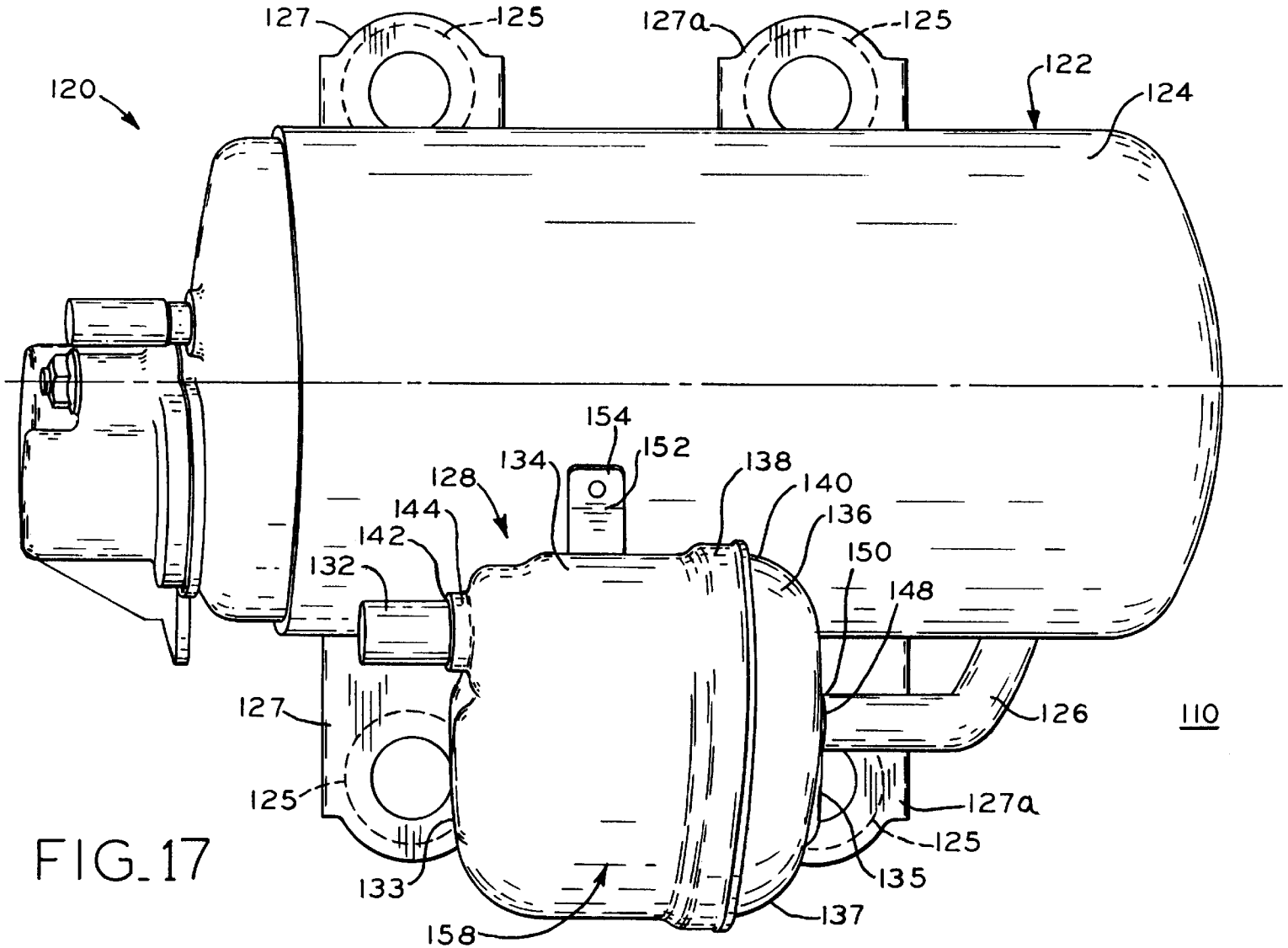
FIG. 17 is a top view of the compressor and accumulator assembly of FIG. 16.
Figure 18:
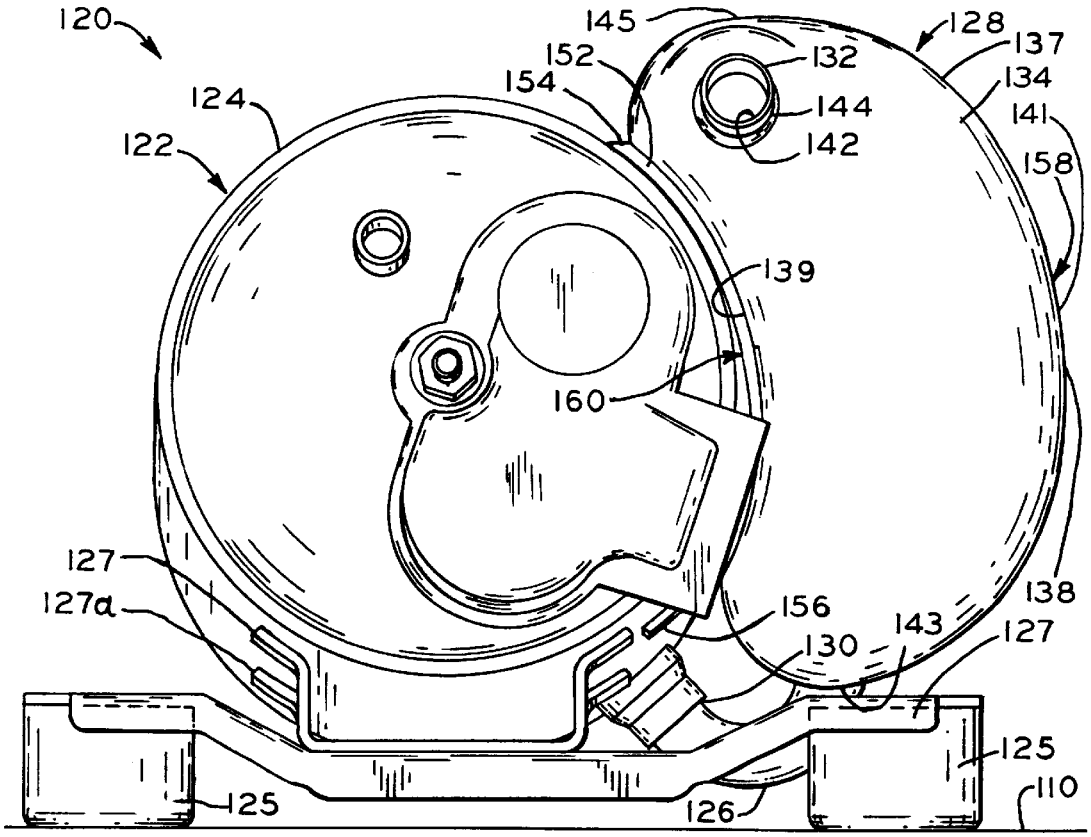
FIG. 18 is an end view of the compressor and accumulator assembly of FIG. 16.

Referring to FIGS. 16–18, there is shown a third embodiment of a compressor and accumulator assembly according to the present invention. Compressor and accumulator assembly 120 comprises horizontal rotary compressor assembly 122 and accumulator assembly 128. The reference numerals referring to each of the elements of compressor and accumulator 120 correspond to elements of compressor and accumulator assembly 20 by adding 100 to the reference numeral of elements comprising compressor and accumulator assembly 20. Thus, it can be seen that horizontal compressor and accumulator assembly 120 comprises hermetic compressor assembly 122 and partially surrounding kidney or hip flask shaped accumulator assembly 128 fluidly connected thereto by means of outlet tube 126 which extends through aperture 130 provided in cylindrical compressor housing 124. Outlet tube 126 is directly attached to the compressor mechanism (not shown), which may be a rotary, scroll or reciprocating piston compressor mechanism, located within the right hand end of compressor housing 124 as viewed in FIGS. 16 and 17. Refrigerant at suction pressure is received from the refrigerant system loop into accumulator assembly 128 through inlet tube 132.

Accumulator housing 137 comprises first accumulator housing portion 134 and second accumulator housing portion 136. Housing portions 136 and 134, respectively, include a pair of end walls 135 and 133 having outlet and inlet tubes 126 and 132, respectively, extending therefrom. Housing portion 136 is adapted to be interfitted, with lower end opening 138 of first accumulator portion 134. First accumulator portion 134 includes an expanded portion such that the upper end opening 140 of second accumulator portion 136 slidably extends therein. This joint is sealed by means of, for example, brazing. Inlet tube 132 extends through aperture 142 in end wall 133 of first accumulator housing portion 134. Aperture 142 is formed by horizontally extending collar 144 which is formed in end wall 133 of housing portion 134, and inlet tube 132 is attached therein by means of, for example, brazing.

Compressor and accumulator assembly 120 is provided with first and second base mounting brackets 127, **127*a* attached to compressor housing 124 and having mounting feet 125 which may be made of a vibration damping material such as, for example, rubber. The assembly is shown on generally horizontal mounting surface 110. As shown in FIG. 16, first and second brackets 127, 127*a* are fashioned to slightly elevate the left hand side of compressor assembly 122, which allows oil disposed within housing 124** to collect at the interior right hand side for providing lubrication to the compressor mechanism therein.

Referring to FIGS. 16, 17 and 18, accumulator housing 137, formed from first and second accumulator housing portions 134 and 136, is generally hip flask shaped and includes a periphery or outermost portion having a kidney shaped cross-section. Referring to FIG. 18, accumulator housing 137 includes a generally continuous exterior surface which includes first surface portion 139 having concave profile 160 which interfaces with the generally curved outer surface of compressor housing 124. Opposite to concave profile 160, positioned radially and outwardly with respect to compressor assembly 122 and first surface portion 139, is convex profile 158 disposed on second surface portion 141 of accumulator housing 137. Side portions, 143 and 145 having generally convex surfaces, connect convex profile 158 to concave profile 160 to form the hip flask shaped accumulator assembly 128. First surface portion 139 superposes, partially surrounding, the generally curved outer surface of compressor housing 124 to promote heat transfer to accumulator housing 137 from compressor housing 124. However, it is envisioned that the interfacing surfaces of accumulator housing 137 and compressor housing 124, may comprise alternative complementary profiles such as planar profiles, jagged profiles, curved profiles or any other suitable superposable profiles which promote high heat transfer and reduce overall assembly size.

Thus, heat generated by compressor assembly 122, via the compressor mechanism and/or the electrical motor therein, transfers to compressor housing 124 and thereafter to accumulator housing 137 to more rapidly vaporize liquid refrigerant.

Figure 19:
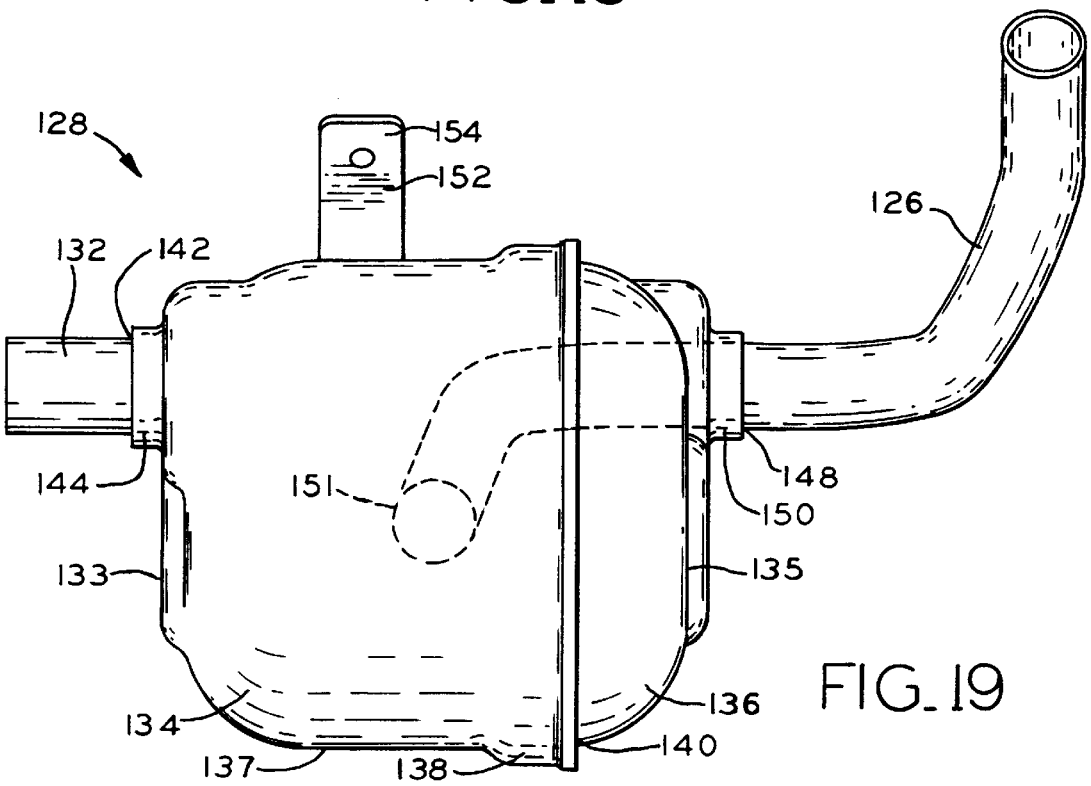
FIG. 19 is a side view of the third embodiment accumulator assembly according to the present invention.
Figure 20:
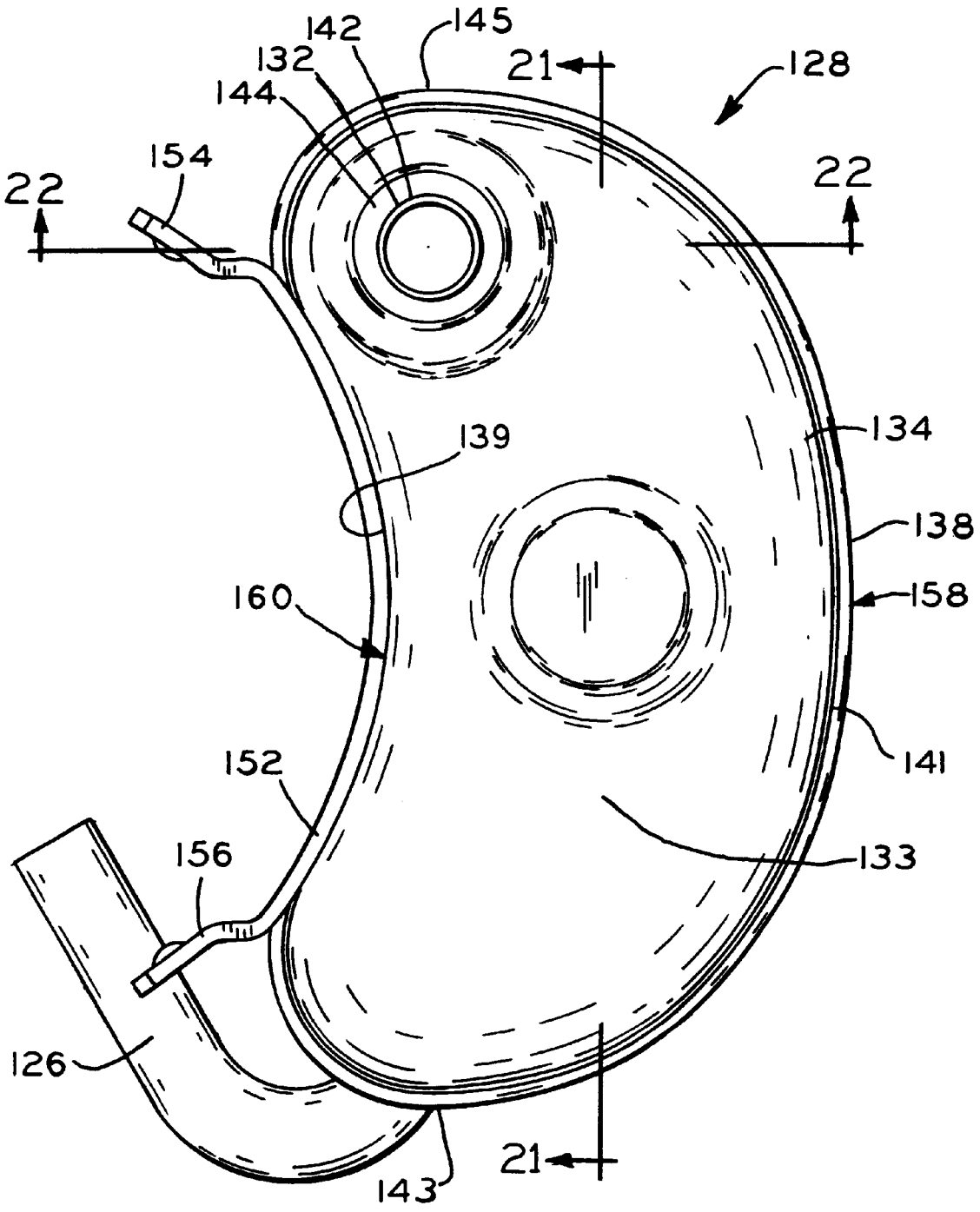
FIG. 20 is an end view of the accumulator assembly of FIG. 19.
Figure 21:
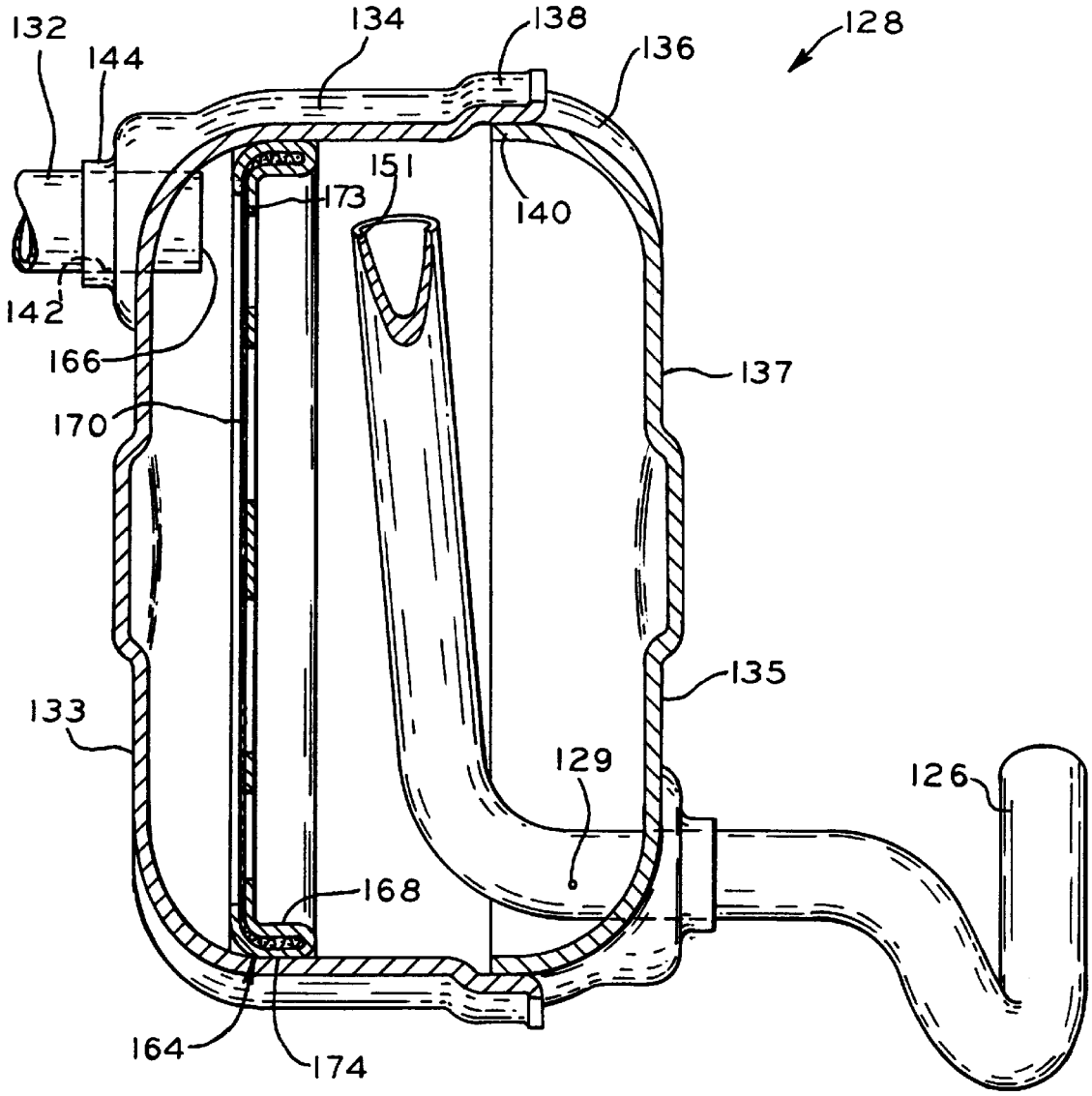
FIG. 21 is a sectional side view of the accumulator assembly of FIG. 20 along line 21—21.
Figure 22:
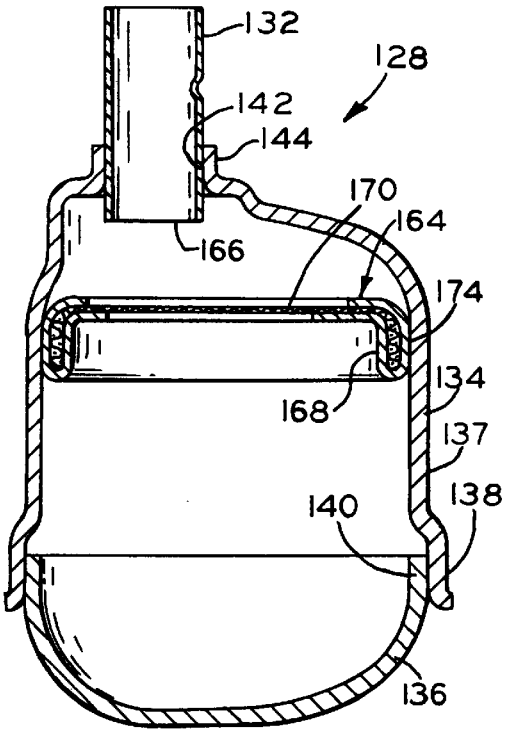
FIG. 22 is a sectional bottom view of the accumulator assembly of FIG. 20 along line 22—22.
Figure 24:
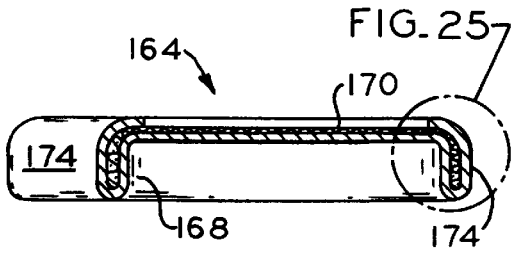
FIG. 24 is a sectional bottom view of the screen assembly of FIG. 23 along line 24—24.
Figure 23:
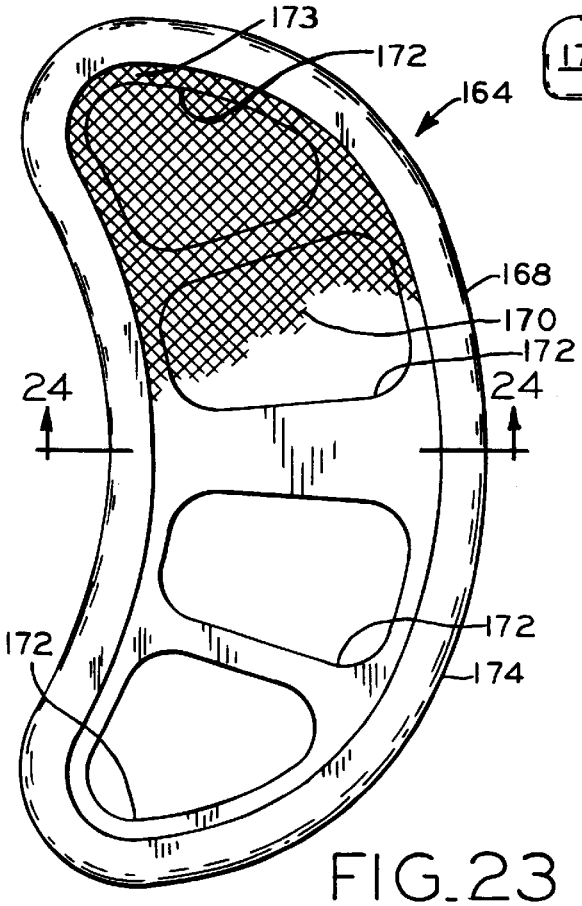
FIG. 23 is an end view of a screen assembly within the accumulator assembly of FIG. 19.
Figure 25:
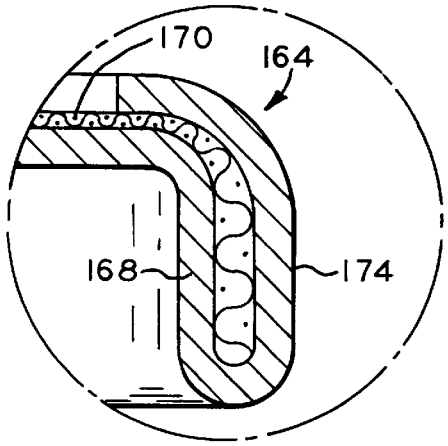
FIG. 25 is an enlarged view of the encircled portion of FIG. 24.

Referring now to FIG. 19, accumulator assembly 128 comprises outlet tube 126 having terminal end 151 which extends generally upwards into the upper inside portion of the accumulator, above the liquid refrigerant surface level. Referring to FIGS. 21 and 22, screen assembly 164 is disposed between terminal end 151 of outlet tube 126 and terminal end 166 of inlet tube 132. Screen assembly 164 comprises frame or holder 168, which conforms to the inside surface of first housing portion 134, and screen element 170 which may be made from interwoven stainless steel, brass or other suitable metallic or non-metallic fibers having a mesh of 80×150 fibers/inch. Like screen element 70, screen element 170 filters debris measuring between 80 and 120 microns to prevent the debris from passing through to the compressor. Referring now to FIG. 23, holder or frame 168 is provided with a plurality of apertures 172 through which refrigerant may pass from one side of screen assembly 164 to the other, the apertures entirely covered by screen element 170. As best seen in FIGS. 21 and 23, frame 168 has wall portion 173 which defines the uppermost edge of uppermost aperture 172. Wall portion 173 extends into the flow path of refrigerant exiting inlet tube 132, and serves to break up liquid refrigerant which impinges against it into small droplets to promote evaporation within the accumulator. Wall portion 173 also deflects the flow of liquid refrigerant from terminal end 166 of inlet tube 132, preventing it from being directly received into terminal end 151 of outlet tube 126 and the compressor cylinder. Like frame 68, frame 168 is provided with means for crimping screen element 170 therein for retaining same (FIGS. 24, 25). Alternatively, the screen element may be welded to frame 168. Frame 168 is also provided with depending perimeter surface 174 which abuts the inside surface of first accumulator housing element 134 and is attached thereto by means of, for example, press-fit, welding or brazing. It should be noted that accumulator assembly 128 may be provided with a baffle plate element similar to baffle plate 76 and which is attached to an interior portion of accumulator housing 137 for improving accumulator assembly 128 strength and/or sound muffling characteristics.

As best shown in FIG. 21, through hole or orifice 129 is positioned in a lower portion of outlet tube 126 in order for compressor lubrication oil, transported to accumulator assembly 128 with the refrigerant, and which may accumulate at the lower portion of accumulator assembly 128, to be reclaimed by compressor assembly 122 (not shown). Orifice 129 having a diameter ranging from 0.025" to 0.060" allows lubrication oil to flow back to the compressor at a suitable rate. The oil received by orifice 129 is conveyed back to the compressor through outlet tube 126.

It is envisioned that all of the above-mentioned brazed connections, including those which assemble the components of accumulator assemblies 28, 28' and 128 may be performed simultaneously. Further, in lieu of attaching the accumulator assembly of the present invention to the compressor housing by means of brazed brackets 52, 52' or 152, the accumulator assembly may be attached to the compressor assembly by means of a belly band or bail strap which encircles the compressor housing.

While this invention has been described as having different embodiments, the present invention can be further modified within the spirit of the scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor and suction accumulator assembly, comprising an accumulator assembly attached to a compressor assembly, wherein said compressor assembly comprises a curved housing and said accumulator assembly comprises a concave surface which partially surrounds said curved compressor housing.

2. The compressor and accumulator assembly of claim 1, wherein said accumulator assembly comprises a convex surface opposite its said concave surface.

3. The compressor and accumulator assembly of claim 2, wherein said concave surface, said convex surface and a pair of side portions define a kidney shaped cross-section.

4. A compressor and suction accumulator assembly, comprising:

a compressor mechanism disposed in a compressor housing, said compressor housing having an outer surface disposed thereon; and an accumulator housing comprising an exterior surface having a first surface portion disposed thereon, said first surface portion of said accumulator housing interfacingly arranged with said outer surface of said compressor housing, said accumulator housing including an inlet and an outlet, said outlet of said accumulator housing in fluid communication with said compressor housing, wherein said first surface portion of said accumulator housing is superposed with said outer surface of said compressor housing.

5. The compressor and accumulator assembly of claim 4, wherein said first surface portion of said accumulator housing abuttingly overlays said outer surface of said compressor housing.

6. The compressor and accumulator assembly of claim 5, wherein said first surface portion of said accumulator housing has a concave profile and said outer surface of said compressor housing includes a curved profile.

7. The compressor and accumulator assembly of claim 6, wherein said exterior surface of said accumulator housing includes a second surface portion disposed thereon, said second surface portion positioned opposite said concave profile.

8. The compressor and accumulator assembly of claim 7, wherein said outer surface of said compressor housing is substantially cylindrical and said second surface portion of said accumulator housing comprises a convex profile.

9. The compressor and accumulator assembly of claim 4, wherein said accumulator housing comprises a first housing portion, a second housing portion and at least one screen assembly disposed within said accumulator housing, said screen assembly located between said inlet and said outlet of said accumulator housing.

10. The compressor and accumulator assembly of claim 4, wherein said accumulator housing comprises first and second housing portions and a central portion therebetween, said accumulator housing including at least one screen assembly disposed within said accumulator housing, said screen assembly located between said inlet and said outlet of said accumulator housing.

11. The compressor and accumulator assembly of claim 4, wherein said inlet of said accumulator housing is positioned above said outlet of said accumulator housing.

12. The compressor and accumulator assembly of claim 4, wherein said inlet of said accumulator housing is laterally positioned relative to said outlet of said accumulator housing.

13. The compressor and accumulator assembly of claim 12, wherein said inlet is disposed in one of a pair of end walls and said outlet is disposed in the other of said pair of end walls.

14. A compressor and suction accumulator assembly comprising a compressor assembly emitting heat through a housing;

conduit means for fluidly connecting said compressor and said accumulator;

accumulator means for receiving refrigerant, retaining liquid refrigerant therein and providing refrigerant gas to said compressor assembly, said accumulator having a surface which is proximal and at least partially surrounds said compressor housing, said accumulator and said compressor housing in thermal communication through said accumulator surface;

whereby a portion of refrigerant liquid retained in said accumulator is transformed into refrigerant gas in response to the transfer of heat from said compressor housing to said accumulator.

* * * * *

UNITED STATES PATENT AND TRADEMARK OFFICE

CERTIFICATE OF CORRECTION

PATENT NO. : 6,220,050 B1
DATED : April 24, 2001
INVENTOR(S) : Edward A. Cooksey It is certified that error appears in the above-identified patent and that said Letters Patent is hereby corrected as shown below:

Abstract,
Line 9, delete "housing" and substitute therefor -- mechanism --

Claim 4, Column 9,
Line 59, change "housing" to -- mechanism --

Signed and Sealed this

Eleventh Day of September, 2001

*Attest:*

Nicholas P. Godici

NICHOLAS P. GODICI
*Acting Director of the United States Patent and Trademark Office*

*Attesting Officer*